US007618014B2

(12) United States Patent
Wang

(10) Patent No.: US 7,618,014 B2
(45) Date of Patent: Nov. 17, 2009

(54) DESK FOR READING AND WRITING

(76) Inventor: Yun-Fei Wang, Suite 502, Unit 2, Building No. 1, B-9TH Garden, Huayua East Road, Haidian District, Beijing (CN)

( * ) Notice: Subject to any disclaimer, the term of this patent is extended or adjusted under 35 U.S.C. 154(b) by 75 days.

(21) Appl. No.: 11/490,828

(22) Filed: Jul. 24, 2006

(65) Prior Publication Data

US 2008/0017776 A1 Jan. 24, 2008

(51) Int. Cl.
*A47B 97/04* (2006.01)
*A47B 23/00* (2006.01)

(52) U.S. Cl. ..... 248/448; 248/349.1; 248/149; 108/49; 108/144.11

(58) Field of Classification Search ..... 248/448, 248/446, 458, 149, 441.1, 349.1; 108/49, 108/144.11
See application file for complete search history.

(56) References Cited

U.S. PATENT DOCUMENTS 602,736 A * 4/1898 De Duboeay ..... 248/456
1,598,569 A * 8/1926 Fitzhugh ..... 108/49
1,898,666 A * 2/1933 Isaacson ..... 108/6
2,807,908 A * 10/1957 Lykes ..... 248/451
4,295,624 A * 10/1981 Granada ..... 248/456
4,591,123 A * 5/1986 Bradshaw et al. ..... 248/179.1
4,669,694 A * 6/1987 Malick ..... 248/397
5,025,353 A * 6/1991 Menaged ..... 362/98
5,297,768 A * 3/1994 Denton ..... 248/442.2
5,690,310 A * 11/1997 Brown ..... 248/448
5,749,556 A * 5/1998 Matsuoka et al. ..... 248/349.1
6,015,120 A * 1/2000 Sweere et al. ..... 248/123.11
6,381,125 B1 * 4/2002 Mizoguchi et al. ..... 361/682
6,595,481 B1 * 7/2003 Huang et al. ..... 248/349.1
7,384,021 B2 * 6/2008 Liao ..... 248/415
2008/0192419 A1 * 8/2008 Sawai ..... 361/681

* cited by examiner

*Primary Examiner*—Anita M King

(57) ABSTRACT

A desk for reading, writing, typing and painting is disclosed. The desk comprises a base plate, a deck, a long sliding track and a sliding positioning element. The base plate comprises a rotatable plate and a sliding hinge. The deck is secured to a tube of the sliding hinge. The long sliding track is attached to the sliding hinge and positioned over the rotatable plate. The sliding positioning element is adopted for positioning the sliding track and the deck.

3 Claims, 3 Drawing Sheets

DESK FOR READING AND WRITING

BACKGROUND OF THE INVENTION

1. Field of Invention

The present invention is generally related to a desk for reading and writing; and more particularly to a desk with a rotatable deck.

2. Description of the Related Art

Generally, people usually write on the desk. The conventional desk is a flat deck positioned at a horizontal level. The user can put the book on the desk or hold the book in hand while reading, the user has to maintain a certain position to read beside the conventional desk. The user easily feel tired after a long time reading due to uncomfortable position.

To overcome the above problem, an improved conventional reading deck is being developed to fit various positions of reading. However, the structure of the desk is more complicated and the appearance is not really good. The reading deck is not assembled to the desk. Another conventionally designed reading deck may be assembled to the desk such that the deck can rotate relative to the desk. However, the deck can be substantially inconvenient to the user when the space is small.

SUMMARY OF THE INVENTION

Accordingly, in the view of the foregoing, the present invention provides rotatable desk capable of rotating in any angle. The user may use the deck of the present invention even in a small space. The desk is suitable to use in any place to fit various reading and writing habit.

The rotatable desk may be conveniently used for reading, writing, typing and painting. The desk of the present invention comprises a base plate having a rotatable plate. The rotatable plate comprises a sliding hinge positioned on a long sliding track. The sliding track comprises a tube to secure the deck, and a positioning element is positioned between the sliding track and the deck.

The rotatable plate is axially positioned on the base plate via an axle, and a gear is positioning co-axially below the rotatable plate. A resilient positioning element is positioned on a frontal side of the base plate. The resilient positioning element can elastically buckle between any two teeth of the gear.

A control key is disposed on an upper side of the base plate and is adopted for buckling the resilient positioning element.

The sliding assembly positioned between the sliding track and the deck comprises a long teeth stripe positioned in the sliding track and a resilient ratchet positioned on the bottom of the deck. The resilient ratchet elastically presses on the teeth strip. The resilient ratchet comprises a handle formed on another side thereof that protrude out from the bottom of the deck.

The elastic restoring element is positioned between the sliding track and the tube. Two distal ends of the elasticity restoring element are fixed to the springs of the sliding track and the tube respectively. The initial position of the spring is at the top of the sliding track.

The rotatable desk of the present invention also comprises a long board book stand horizontally secured at the bottom of the deck and positioned perpendicular to the deck.

The rotatable desk further comprise a book holder, for example, a fixed resilient book holder, a removable magnetic book holder or a movable resilient book holder.

The deck of the rotatable desk of the present invention can be fixed on the tube along the sliding track. Thus, the deck can be positioned by the sliding positioning element according to the user need. The sliding track is positioned on the rotatable plate through the sliding hinge, so that the angle of the sliding track can be adjusted using the sliding hinge as the axis to adjust the angle of the deck as desired by the user. The sliding hinge is rotatably positioned on the rotatable plate which positioned by the resilient positioning element on the base plate to flexibly position the rotatable plate and the deck. Accordingly, the rotation angle and the height of the deck may be adjusted according to the user need. The desk may also be adjusted in any specific angles. Therefore, the rotatable desk of the present invention can meet the reading and writing habit of the users and thereby reduce the pain to the user.

BRIEF DESCRIPTION OF THE DRAWING

For a more complete understanding of the present invention, reference will now be made to the following detailed description of preferred embodiments taken in conjunction with the following accompanying drawings.

DETAIL DESCRIPTION OF THE INVENTION

Figure 1:
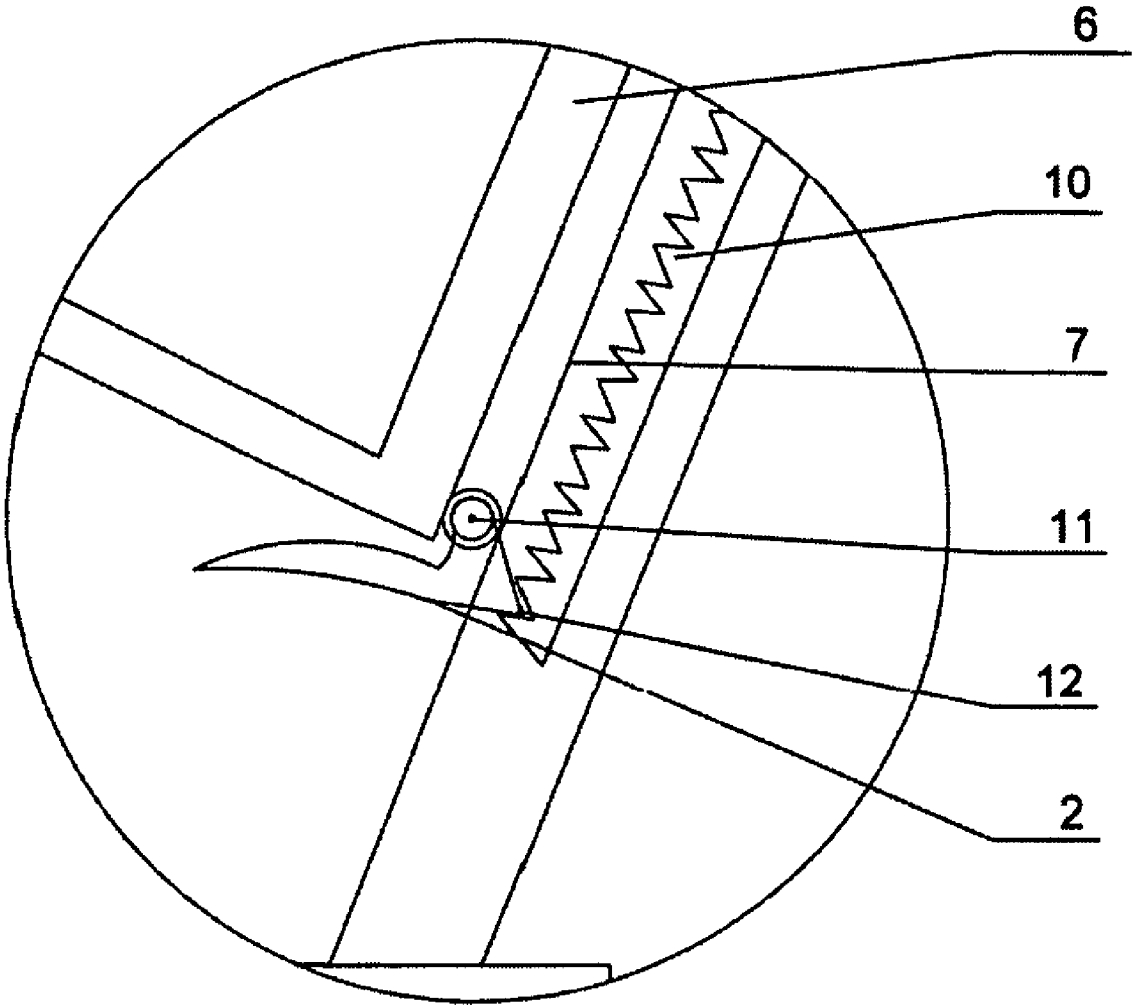
FIG. 1 is a side view of a rotatable desk according to an embodiment of the present invention.
Figure 2:
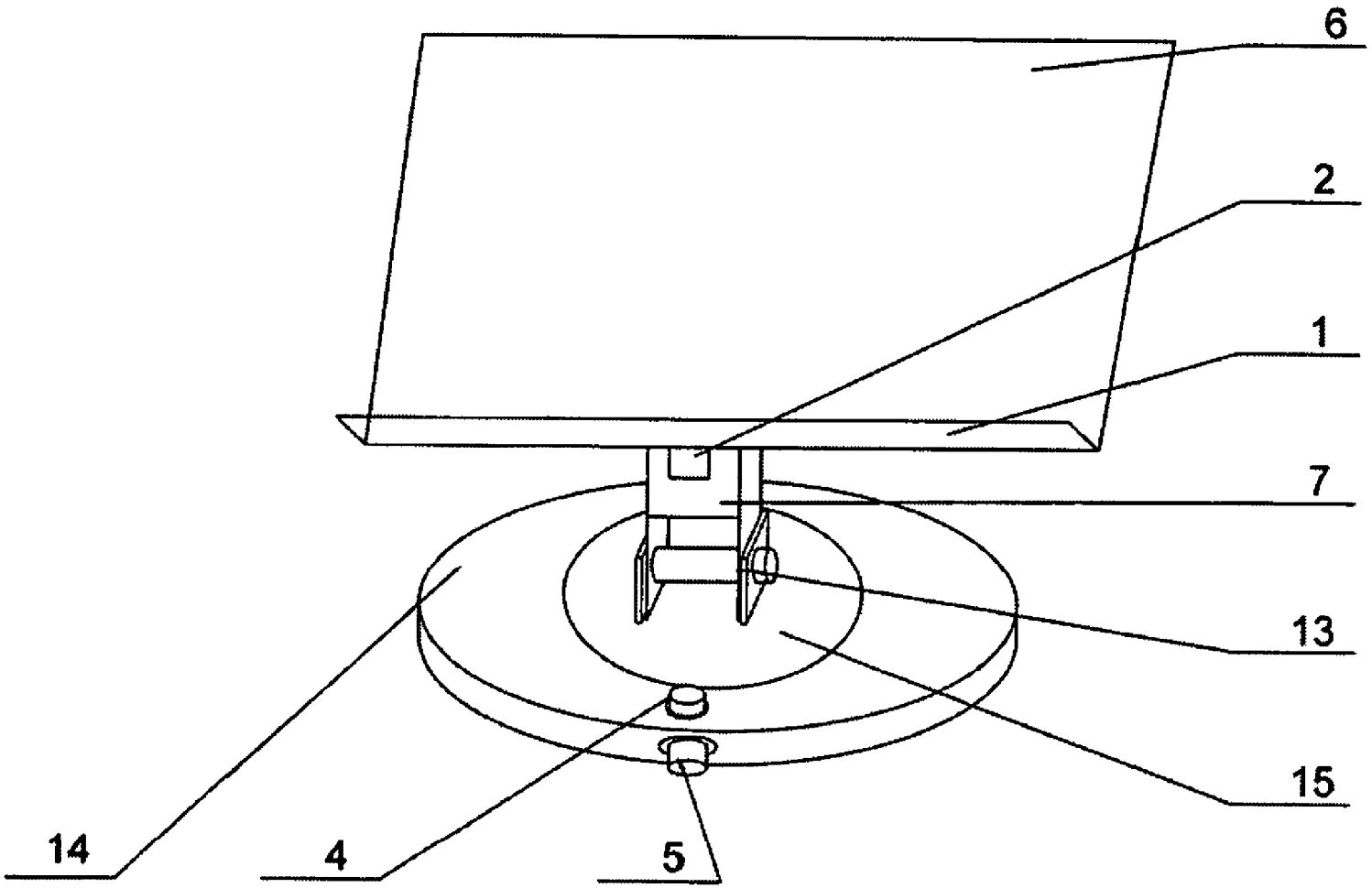
FIG. 2 is a perspective view of a rotatable desk according to an embodiment of the present invention.
Figure 3:
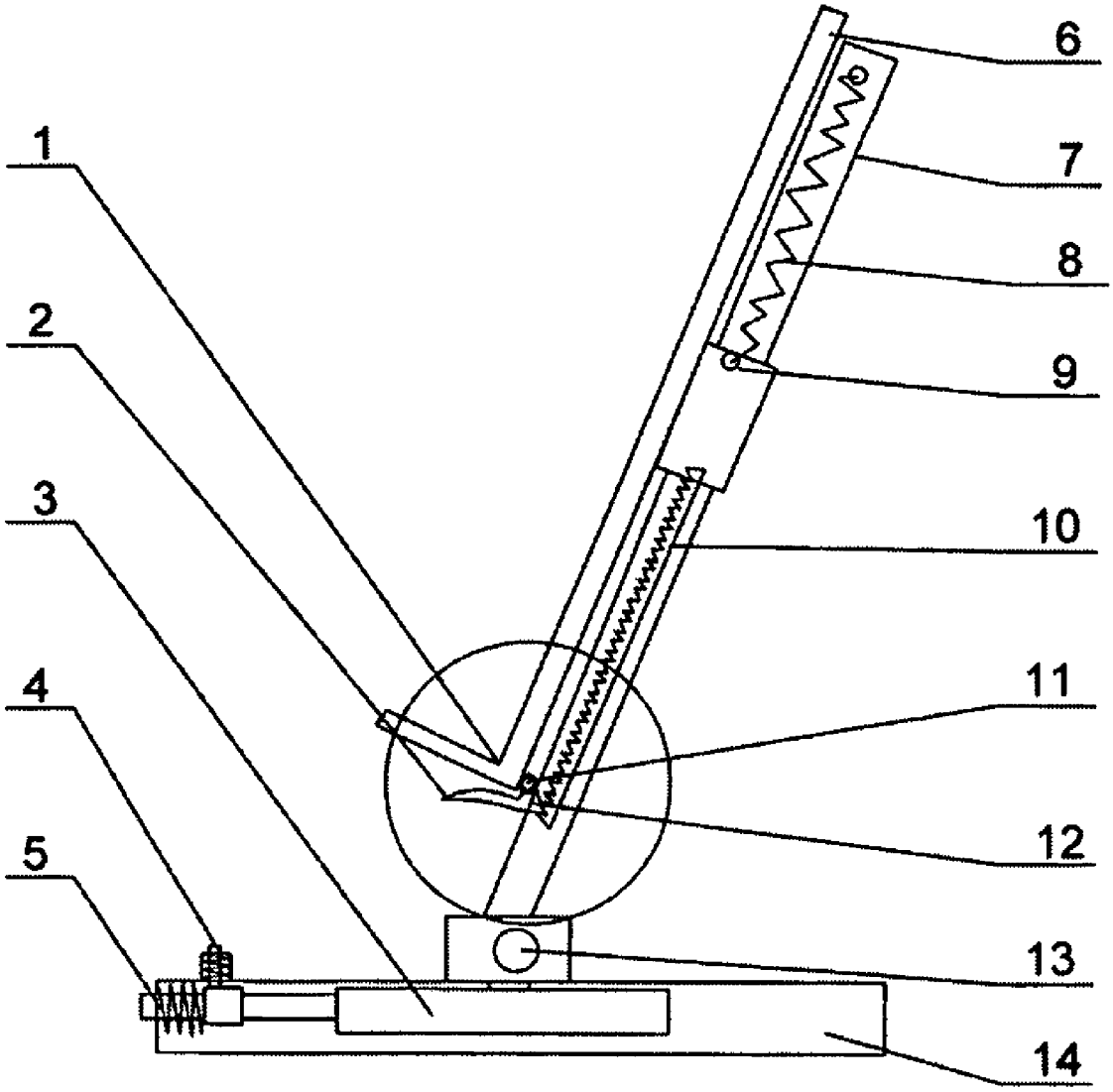
FIG. 3 is a cross sectional view of FIG. 1 according to an embodiment of the present invention.

Referring to FIGS. 1, 2 and 3, the rotatable desk comprises a base plate 14 having a rotatable plate 15 connected to a long sliding track 7 through a sliding hinge 13. The sliding track 7 extends upwardly, and comprises a tube 9 for securing a deck 6, wherein the deck 6 can slide along the sliding track 7 along with the tube 9 such that the deck 6 moves up and down.

Referring to FIGS. 1 and 3, for positioning the deck 6 freely on the sliding track 7, the sliding track 7 comprises a long teeth strip 10 positioned along the sliding track 7, wherein the teeth stripe 10 faces the deck 6. A resilient ratchet 12 is positioned on the bottom of the deck 6. The resilient ratchet 12 elastically presses on the teeth stripe 10 for buckling positioning the resilient ratchet 12. The resilient ratchet 12 is positioned on an axle 11 positioned on the bottom of the deck 6. The axle comprises a spring to provide elasticity to the ratchet 12. The resilient ratchet 12 comprises a handle 2 for releasing the resilient ratchet 12 from the teeth strip 10 to enable the deck 6 move up and down.

Referring to FIGS. 1 and 2, the rotatable plate 15 is rotatably engaged to the base plate 14 via an axle. A gear 3 is coaxially disposed on the outer flange of the rotatable plate. The gear 3 rotates synchronized with the rotatable plate 15. The base plate 14 has a resilient positioning element 5 and a key 4 at the frontal side thereof. The positioning element 5 comprises a head at the rear side, which may be adopted to fit between two adjacent teeth of the gear 3 in order to stop the rotation of the gear 3. The resilient positioning element 5 comprises a buckle to vertically position the key 4 relatively to the positioning element 5 in order to lock or release the positioning element 5 for rotating or stopping the gear from rotation. Thus the rotating plate and the deck can be freely rotated and positioned accordingly.

The rotatable plate 15 can be freely rotated and positioned to correspondingly freely rotate and position the deck 6. The structure of the sliding hinge 13 and the sliding track 7 allows the sliding track 7 and the deck 6 to be positioned and adjustable along a horizontal direction. The sliding track 7 and the tube can slide and position correspondingly, so that the height of the deck can be adjusted as required. Thus, the horizontal level, the height and the rotation angle of the deck can be adjusted according to the user need.

For making the elevation function easy and energy saving, a restoring element may be installed between the sliding track 7 and the tube 9, or between the sliding track 7 and the deck 6. For example, two ends of a spring 8 may be respectively installed on the sliding track 7 and the tube 9 in the sliding track 7, and the initiating position of the spring 8 is at the highest position of the tube 9. Thus, by applying a small amount of downward, the height of the deck may be adjusted due to the elasticity. Thus, a substantially less effort is required to adjust the height of the deck.

Referring to FIGS. 1 and 2, the bottom of the deck comprises a book stand 1 for placing the books with various thickness. Furthermore, for placing various kinds of books, the deck 6 of the present invention may be equipped with a fixed resilient book holder, a removable magnetic book holder or a movable resilient book holder.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. A desk for reading, writing, typing and painting comprising:

a base plate having a rotatable plate;

a long sliding track having a tube and being positioned over said rotatable plate to connect with said rotatable plate with a sliding hinge; and a deck being secured to said tube such that said desk is capable of moving along said sliding track with said tube;

wherein said rotatable plate is axially positioned on said base plate with a gear being positioned on an outer flange of said rotatable plate, and said base plate further comprises a resilient positioning element on a frontal side thereof and said resilient positioning element has a head disposed between and elastically fitting with two adjacent teeth of the gear for stopping rotation of said gear.

2. The desk according to claim 1, wherein said base plate further comprises a key on an upper side thereof to position said resilient positioning element.

3. The desk according to claim 1, wherein a spring serving as a restoring element is disposed between said sliding track and said tube with two ends respectively fixed to said sliding track and said tube in the sliding track, and wherein an initial position of said spring is at a highest position of said tube.

* * * * *